US006719153B2

(12) United States Patent
Heneveld

(10) Patent No.: US 6,719,153 B2
(45) **Date of Patent: *Apr. 13, 2004**

(54) STORAGE RACK FOR ELONGATED ITEMS

(76) Inventor: William R. Heneveld, 431 Adaway Dr., SE., Grand Rapids, MI (US) 49546

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/232,930

(22) Filed: Jan. 19, 1999

(65) Prior Publication Data

US 2001/0003331 A1 Jun. 14, 2001

Related U.S. Application Data

(63) Continuation-in-part of application No. 09/067,285, filed on Apr. 27, 1998, now Pat. No. 6,041,947.

(51) Int. Cl.[7] ..... A47F 7/00
(52) U.S. Cl. ..... 211/70.6; 211/70.1
(58) Field of Search ..... 211/65, 66, 60.1, 211/70.1

(56) References Cited

U.S. PATENT DOCUMENTS

| | | | | | |
|---|---|---|---|---|---|
| 325,196 | A | * | 8/1885 | Caldwell | 211/70.1 |
| 374,794 | A | | 12/1887 | Kilmer | 211/65 |
| 453,969 | A | | 6/1891 | Flack | 211/65 |
| 468,802 | A | * | 2/1892 | Hager | 211/70.1 |
| 553,445 | A | | 1/1896 | Zimmerlin | |
| 659,195 | A | | 10/1900 | Best | |
| 766,964 | A | | 8/1904 | Danhour | 211/65 |
| 776,764 | A | | 12/1904 | Squire | |
| 838,473 | A | | 12/1906 | Speiser | 211/65 |
| 900,014 | A | | 9/1908 | Hennermann | |
| 1,061,431 | A | | 5/1913 | West | 211/60.1 |
| 1,121,513 | A | | 12/1914 | Lench | |
| 1,170,231 | A | * | 2/1916 | Flint | 40/658 |
| 1,188,791 | A | * | 6/1916 | Knechtel | 211/70.1 |
| 1,234,615 | A | | 7/1917 | Bourdeau | |
| 1,291,349 | A | * | 1/1919 | Ackers | 211/65 |
| 1,304,427 | A | | 5/1919 | Wheeler | |
| D65,357 | S | * | 7/1924 | Strnad | D6/528 |
| D67,989 | S | | 8/1925 | Balmer | |
| 1,559,842 | A | | 11/1925 | Bollinge | |
| 1,586,965 | A | * | 6/1926 | Hyman | 211/70.6 |
| D71,202 | S | * | 10/1926 | Nitsche | D6/531 |
| D75,828 | S | | 7/1928 | Canfield | 211/60.1 |
| 1,987,159 | A | | 1/1935 | Rasmussen | 211/60.1 |
| 2,028,694 | A | * | 1/1936 | Spinks | 211/65 |
| 2,119,217 | A | * | 5/1938 | Rocchi | 206/16 |
| 2,291,381 | A | * | 7/1942 | Drake | 211/60.1 |

(List continued on next page.)

FOREIGN PATENT DOCUMENTS

| | | | |
|---|---|---|---|
| FR | 2619295 | 8/1987 | 211/65 |

*Primary Examiner*—Daniel P. Stodola
*Assistant Examiner*—Khoa Tran
(74) *Attorney, Agent, or Firm*—Price Heneveld Cooper Dewitt & Litton

(57) ABSTRACT

A storage rack for compactly holding elongated items such as garden tools, brooms, and the like. The rack is preferably one piece and uses the depth out away from the wall to hold multiple items. In one embodiment, the rack has an upper leg and a lower leg extending from the surface on which it is supported so as to support the items at two places to hold them securely in place. A second embodiment includes only one leg extending from the vertical surface on which it is supported. The slots in the one leg rack are shaped so as to support items securely. Both embodiments easily receive and release the items individually without having to remove any of the other items.

30 Claims, 7 Drawing Sheets r

U.S. PATENT DOCUMENTS 2,308,533 A * 1/1943 Owen ..... 211/13
2,468,190 A 4/1949 Friedheim ..... 211/70.6
2,587,226 A * 2/1952 Rodman ..... 211/60.1
D180,106 S 4/1957 Seifert ..... 211/60.1
2,815,863 A 12/1957 Larson ..... 211/60
2,833,419 A * 5/1958 Trumpy ..... 211/60.1
2,904,188 A 9/1959 Richardson ..... 211/65
2,917,182 A * 12/1959 Browne ..... 211/65
2,940,200 A 6/1960 Endlich ..... 211/65
2,957,584 A * 10/1960 Jenkins ..... 211/65
3,021,012 A * 2/1962 Brown ..... 211/60
3,095,092 A * 6/1963 Magarian ..... 211/60.1
3,153,526 A 10/1964 Pawsey ..... 248/221
3,298,531 A * 1/1967 Wilcke ..... 211/60.1
3,537,599 A 11/1970 Mathisen ..... 211/60
3,702,136 A 11/1972 Albertson ..... 211/70.6
3,721,348 A 3/1973 Cook ..... 211/60
3,822,019 A 7/1974 Baatz ..... 211/70.6
3,837,477 A 9/1974 Boudreau ..... 211/70.6
3,985,324 A * 10/1976 Larson ..... 248/223
4,310,094 A 1/1982 Hotchkiss, Jr. ..... 211/60
4,313,587 A 2/1982 Loeschen ..... 248/217.2
4,353,465 A 10/1982 Rado ..... 211/70.6
4,566,597 A * 1/1986 Caputo et al. ..... 211/87
4,583,647 A * 4/1986 Schinzing ..... 211/60.1
4,809,940 A 3/1989 Trestyn ..... 248/220.4
4,830,198 A * 5/1989 Colquitt ..... 211/60.1 X
4,871,074 A 10/1989 Bryson et al. ..... 211/13
5,005,710 A * 4/1991 Hofer ..... 211/70.6
5,097,966 A * 3/1992 Miller ..... 211/87
5,224,609 A 7/1993 Bauer et al. ..... 211/70.6
5,335,799 A * 8/1994 Coudron ..... 211/65
5,346,063 A 9/1994 Chow ..... 211/70.6
5,505,316 A 4/1996 Lee ..... 211/70.6
5,598,924 A 2/1997 McCann ..... 211/70.6
5,609,259 A 3/1997 Menard ..... 211/66
5,638,964 A 6/1997 Ernst ..... 211/70.6
5,678,700 A 10/1997 Crosson, Jr. ..... 211/60.1
5,884,781 A * 3/1999 Ehrhart ..... 211/70.5
5,979,675 A * 11/1999 Moriarty ..... 211/60.1
6,003,691 A * 12/1999 Owen ..... 211/65
6,041,947 A * 3/2000 Heneveld ..... 211/70.6
6,142,320 A * 11/2000 DeLorean et al. ..... 211/70.6

* cited by examiner

STORAGE RACK FOR ELONGATED ITEMS

This invention is a continuation-in-part of patent application Ser. No. 09/067,285, filed on Apr. 27, 1998, now U.S. Pat. No. 6,041,947 and entitled "STORAGE RACK FOR ELONGATED ITEMS." It relates to a storage rack for compactly holding long handle garden tools and brooms or the like from the wall of a garage or other storage place.

BACKGROUND OF THE INVENTION

Storage racks for hanging garden tools or the like have been in existence for some time. However, to my knowledge, none of these storage racks have been capable of being manufactured cost effectively and at the same time function to efficiently store a large variety of differently configured items having long handles such as rakes, shovels, brooms, hoes, ball bats, and the like. Such racks like that disclosed in U.S. Pat. No. 3,721,348 have been constructed of a number of parts welded together making them costly both from the cost of the parts and the assembling of the same. Further, none of these types of racks has been effective in easily receiving and individually holding the items.

SUMMARY OF THE INVENTION

In accordance with my invention, I provide a storage rack which is a unique, simple rack, preferably one piece, that extends from the wall on which it is mounted and uses the depth out away from the wall to hold multiple items having an elongated part. In one embodiment, the rack preferably includes an upper leg formed by an upper rectangular barshaped section extending at an angle away from the vertical surface and an inclined lower leg formed by a lower rectangular bar section connected to the upper bar and extending at an inclined angle downwardly from the upper bar section toward the vertical support surface, thus supporting the upper bar which includes a series of uniquely shaped slots spaced along its length. Each slot of the upper bar is uniquely shaped to receive an elongated part of the item to be supported. Although the upper bar with its uniquely shaped slots can be constructed to adequately support the items, as described hereinafter, the lower inclined bar section includes a series of second slots spaced along its length and shaped to receive an elongated part of the item to be supported. The slots in the upper bar and the slots in the lower bar are positioned with respect to each other to receive the elongated part of the item to be supported in a desired relationship. The free ends of the two bars each includes means at their ends for attaching the entire bar to a vertical support surface for mounting the rack on a vertical support surface.

In this embodiment of my invention, the upper leg is substantially horizontal but slightly inclined toward the wall on which the rack is supported. The angle of this upper leg and the shape of the slots in the upper leg is such that the slots provide an inlet opening portion at one side of the bar leading into a retainer opening portion extending from the inlet opening toward the inclined angle of the rack. Preferably, such inclination is toward the wall on which the rack is mounted. Thus, when an elongated part is inserted into the inlet opening portion the entire item slides into the retainer opening portion by virtue of gravity and the inclination of the upper bar thus more securely holding the item in the slots. The unique shape of the retainer opening portion also helps to hold items more securely.

Another form of this embodiment of this invention is to locate the slots in the lower inclined bar at a position aligned with but offset slightly from the vertical of the slots in the upper bar. This offset of the slots helps to contain the stored items in the rack and helps hold the elongated portions of the items at a desired angle.

In a second embodiment of my invention, a single leg is formed by an L-shaped bar extending at an angle away from the vertical surface. The L-shaped bar is supported on the vertical surface by an integral flange with attachment elements securing the flange to the vertical surface. Within the broadest aspect of this invention, other means for supporting the leg to a vertical surface is contemplated. The strength of the single leg is reinforced by a second integral flange extending downward along one edge of the leg forming the L-shaped bar. The uniquely shaped slots for supporting elongated items are provided in spaced relationship along the other edge of the leg.

These and other features, advantages and objects of the present invention will be further understood and appreciated by those skilled in the art by reference to the following specification, claims and appended drawings.

DETAILED DESCRIPTION OF THE FIRST EMBODIMENT

Figure 2:
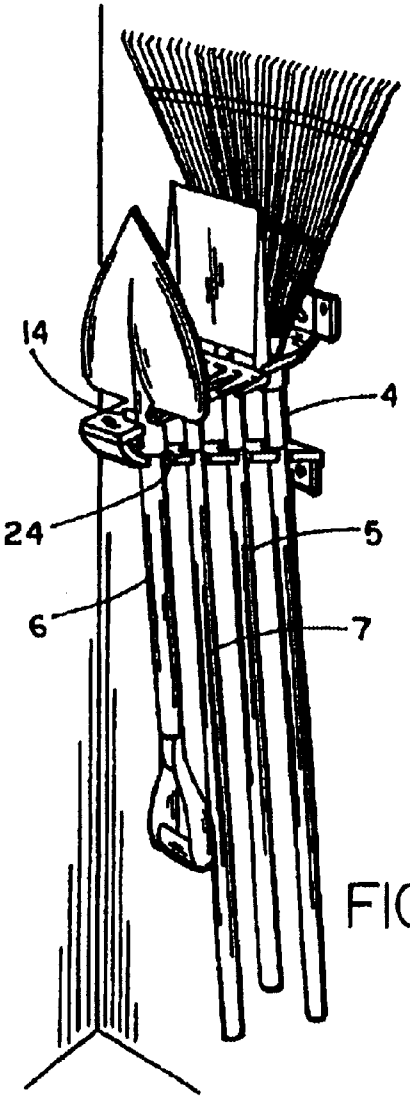
FIG. 2 is a side elevational view of the rack of FIG. 1 containing a number of different items stored on the rack.
Figure 1:
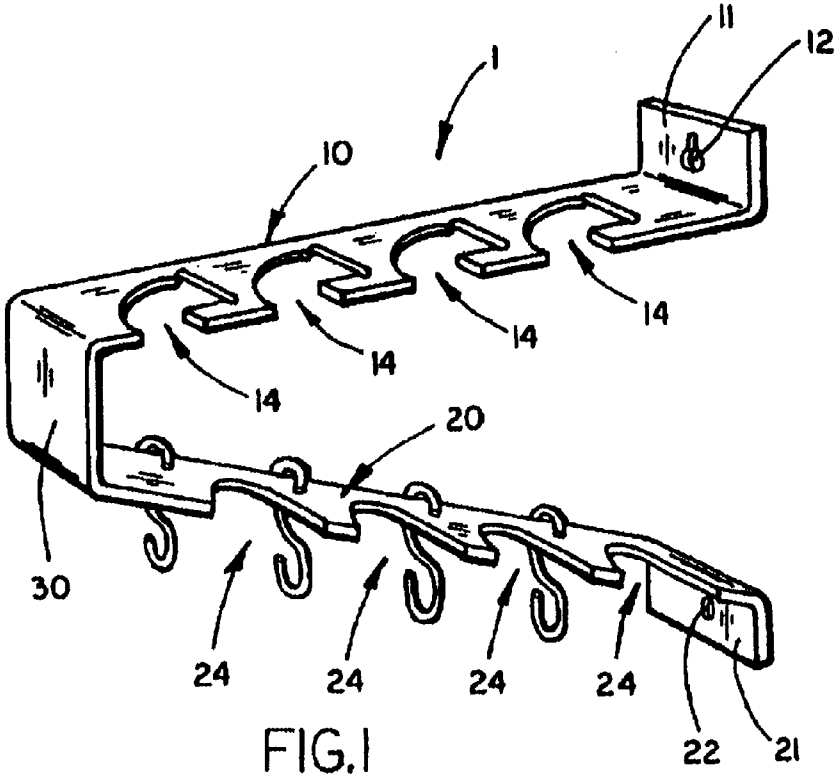
FIG. 1 is a side elevational perspective view of a first embodiment of my invention comprising my storage rack.

Referring to the drawings, reference numeral 1 designates the overall support rack of this invention which includes an upper bar-like section 10 and a inclined lower bar-like section 20 connected together by the bight section 30.

The bar-like section 10 includes a flange 11 extending upwardly from the free end. Flange 11 is provided to secure or mount the rack on a wall or stud of a garage or other storage building. For this purpose, a central opening 12 having a key-like shape for receiving attachment member such as a screw or nail is provided.

Figure 4:
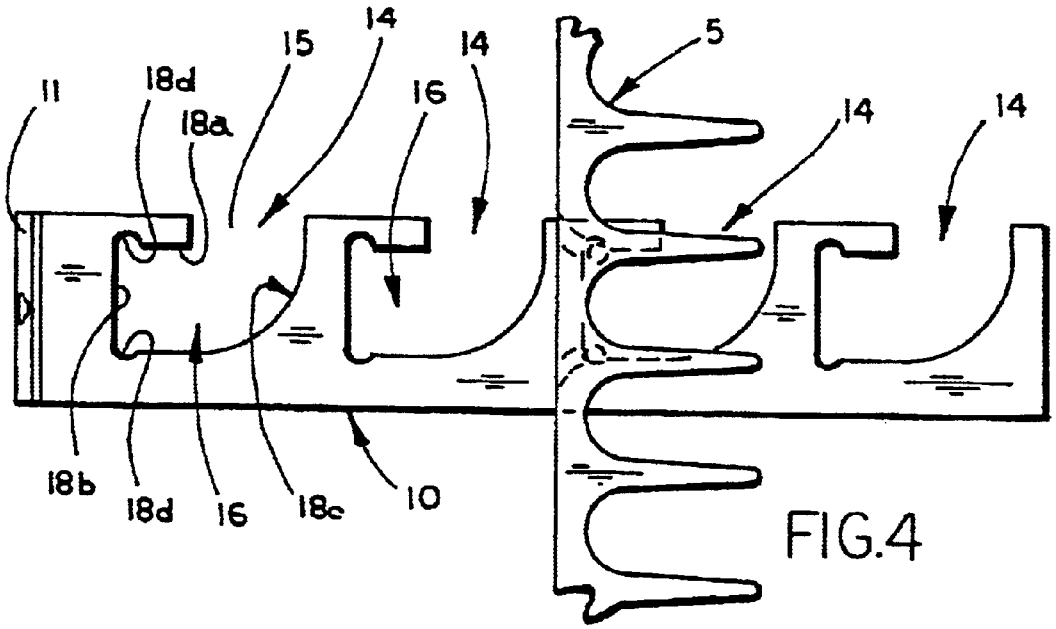
FIG. 4 is a partial plan view of the rack of FIG. 1 disclosing the unique shape of the slots in the top bar section of the rack of FIG. 1.

The bar-like section 10 includes the uniquely shaped slots, the shape of which is best disclosed in FIG. 4. Referring to FIG. 4, slots 14 each comprise an entrance opening portion 15 on one side of the bar-like section 10. Inlet opening portion 15 leads into a retainer opening portion 16. The slot 14 takes the form of the edge 18*a*, edge 18*b*, and the arcuate edge 18*c*. Between edge 18*a*, 18*b*, and 18*c* are provided the recesses or indentations 18*d* provided to receive the bowed support members of a rake such as rake 5 of FIG. 2 as illustrated in FIG. 4. The sizes of slots 14 are sufficiently large to receive an elongated member of the tool or other item such as a handle.

Figure 3:
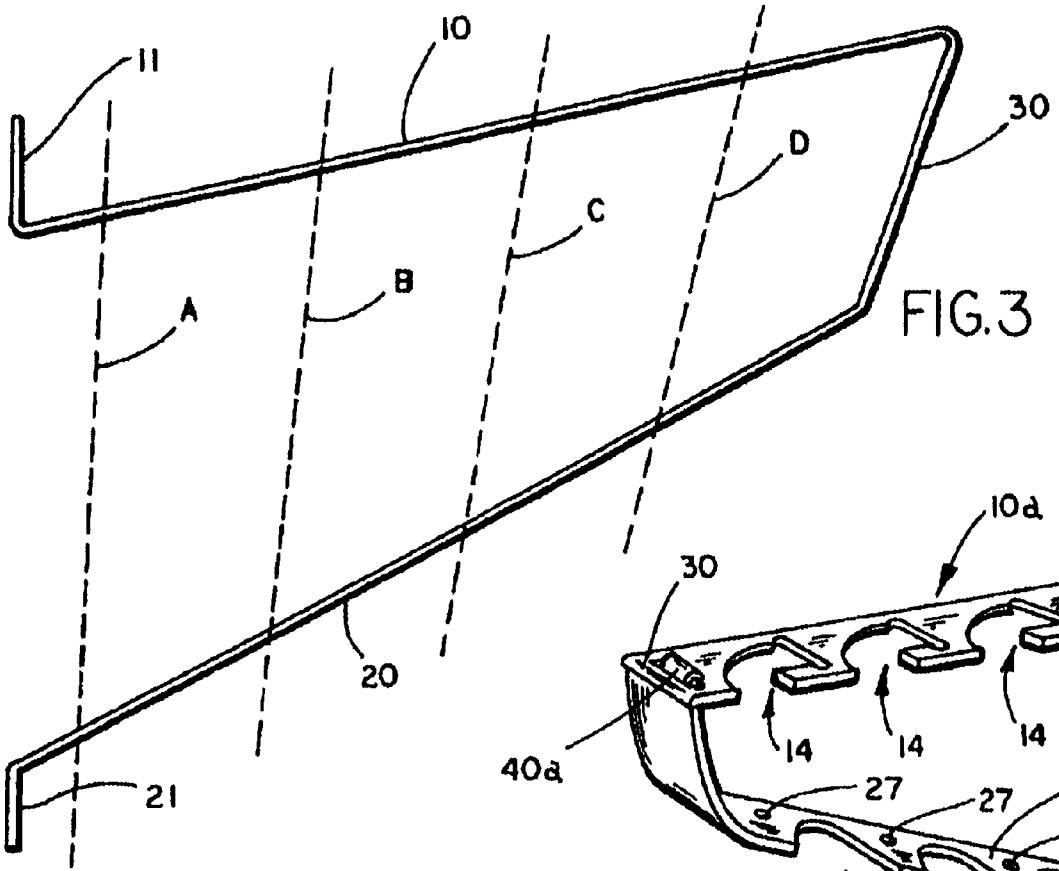
FIG. 3 is a side elevational view of the rack of FIG. 1.

It will be noted that the bar-like section 10 although substantially horizontal is inclined a slight angle of about 10 to 15 degrees (FIG. 3) so that when the handle of an elongated element of the tool or other item is inserted in the entrance opening portion 15 of a slot it will slide downwardly along edge 18*c* (FIG. 4) by reason of the indentation of bar 10 toward the surface on which the rack is mounted so as to abut against the edge 18*b* of each slot.

Figure 5:
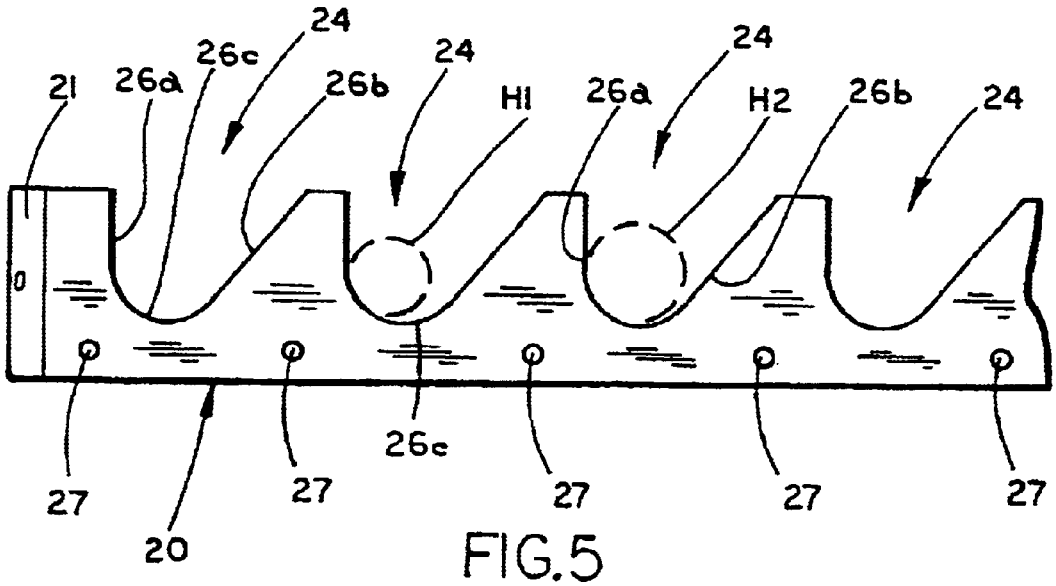
FIG. 5 is a plan view of the lower inclined bar section of the rack of FIG. 1 illustrating the preferred shape of the slots.
Figure 7:
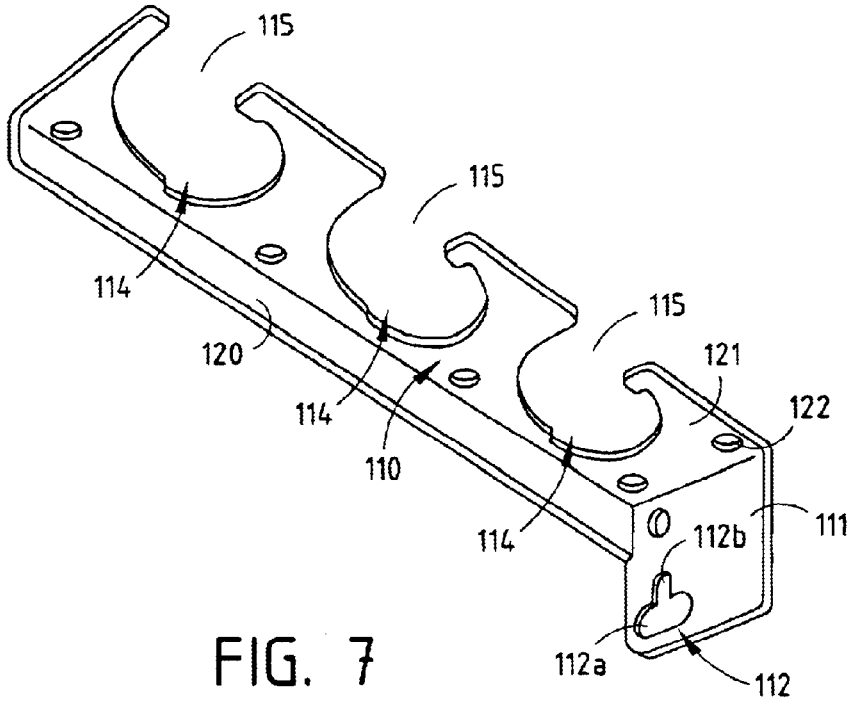
FIG. 7 is a side elevational perspective view of a second embodiment of my invention.
Figure 8:
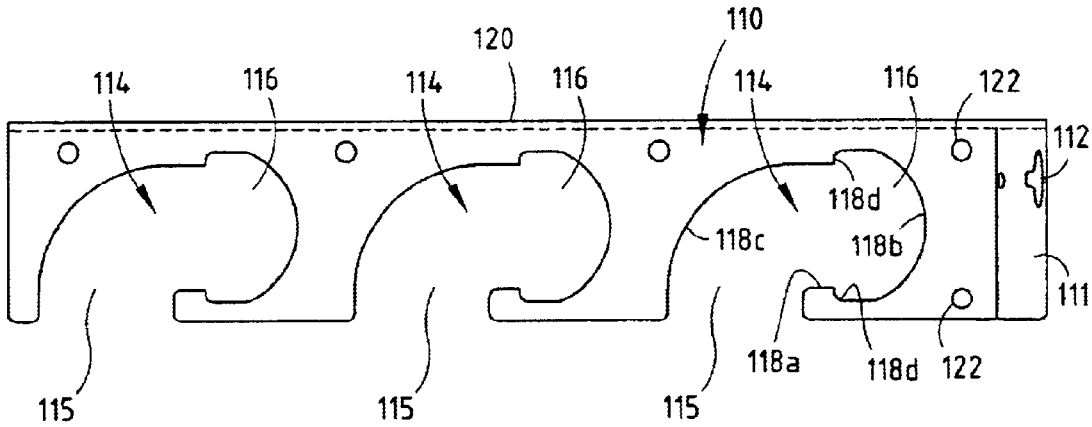
FIG. 8 is a plan view of the rack of FIG. 7 disclosing the unique shape of the slots.

The lower inclined bar section 20, in FIG. 5 also includes a flange 21 at its free end (i.e., opposite the bight portion 30) for securing the bar section 20 to the surface on which the rack is to be mounted. Bar section 20 provides a support for the bar section 10 and also includes a series of slots 24. Bar section 20 also includes a plurality of openings 27 for receiving hooks on which items such as hand tools and the like can be hung.

Slots 24 are positioned vertically under slots 14 but slightly inwardly to the wall on which the rack is to be mounted. The purpose of this location is to mount the elongated handles or other items at an angle slightly inclined toward the wall on which the rack is mounted as illustrated by the phantom lines A, B, C, and D in FIG. 3. The relationship of the associated slots on the upper and lower legs is such that when in use the angle toward the wall of the elongated handle is greater as its position moves away from the wall. Slots 24 (FIG. 5) include the inlet openings that are shaped to provide a straight edge 26*a* and an inclined edge 26*b* connected together by the arcuate edge section 26*c*. The inclined edge 26*b* is provided to accommodate different size handles in the slot 24. Thus, smaller diameter handles as illustrated by handle H1 will engage the crest of arcuate edge 26*c* while larger diameter handles as illustrated by handle H2 will engage edge 26*a* and edge 26*b*. The flat edge 26*a* is provided to maintain a consistent desired angle of the handles so as to hold them out of the way toward the wall.

Figure 6:
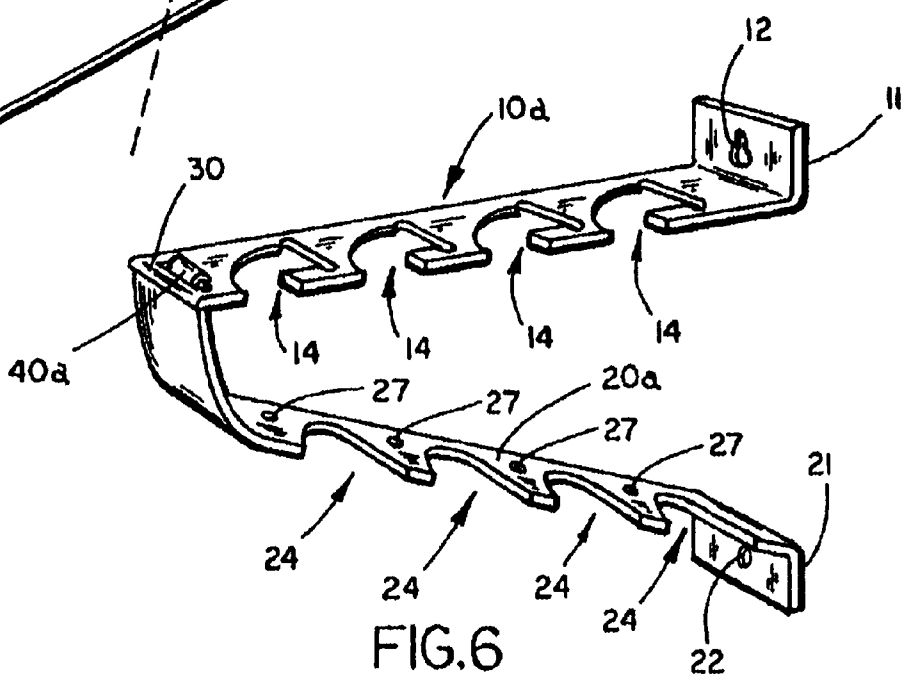
FIG. 6 is a modified rack of the first embodiment of my invention constructed of two pieces.

Although the preferred form of the rack is constructed of one piece as disclosed in FIGS. 1–5, the rack can be constructed of two pieces as disclosed in FIG. 6 wherein the ends of the bar-like sections 10*a* and 20*a* are formed with interlocking end members 30*a* and 40*a*. In this modification, the two parts 10*a* and 20*a* can be shipped unassembled and when installed the two fingered ends 30*a* and 40*a* are meshed together and the unit as a whole is secured to the surface of a wall on which it is mounted.

The advantage of a two piece rack is the minimization of the carton size in which the rack is shipped and sold. The disadvantage is that the two parts 10*a* and 20*a* are required to be attached to each other before mounting the rack on the wall. Also, the strength of the rack can be adversely affected because of the attachment to parts 10*a* and 20*a* together.

OPERATION OF THE FIRST EMBODIMENT

The operation of the rack should be evident from the above description. FIG. 2 discloses a rack mounted on a wall 2. This is accomplished by first deciding the height the rack is to be installed. Next a screw is screwed into the wall such as a solid surface or stud of a building leaving a slight gap between the head and the wall. The bottom circular part of key hole opening 12 is then inserted over the head of the screw and the rack 1 is pulled down causing the head of the screw to be captured over the narrower upper section of the key hole 12. The rack is then adjusted to be vertical, that is, with the bar section 10 located directly above the bar section 20. Then a screw or other attachment member is inserted through opening 22 in the flange 21 of bar section 20. This mounts the rack securely to the surface of the building ready for use.

The items having elongated members such as a rakes 4 and 7, shovels 5 and 6, and brooms are then slid into the nearly vertically aligned openings 14 and 24. Since both of the bar sections 10 and 20 are inclined downwardly toward the wall and the slots 14 and 24 are slightly misaligned vertically, the elongated elements of the tools or other items such as the handles as disclosed seek the reception portion of slots 14 as the handles slide downwardly on the edges 18*c* to rest against the straight edge 18*b* between the indentations of the bar section 20. The handles also slide downwardly on edge 26*b* to rest against the straight edge 26*a* within the curvilinear edge 26*c* of bar section 20.

DESCRIPTION OF THE SECOND EMBODIMENT

Figure 9:
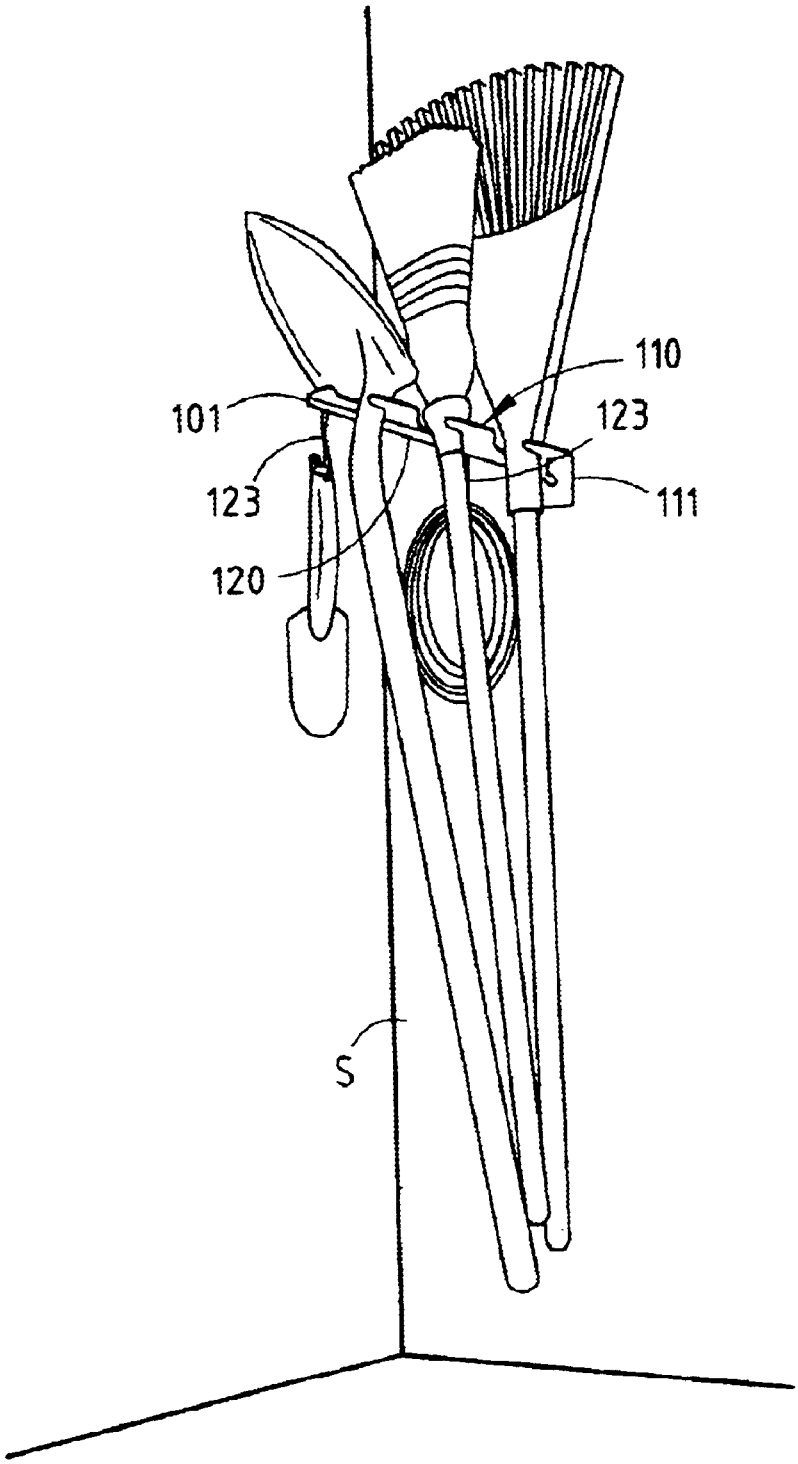
FIG. 9 is a side elevational perspective view of the rack of FIG. 7 supported on a vertical surface fully loaded with elongated items with hooks supporting additional items.
Figure 10:
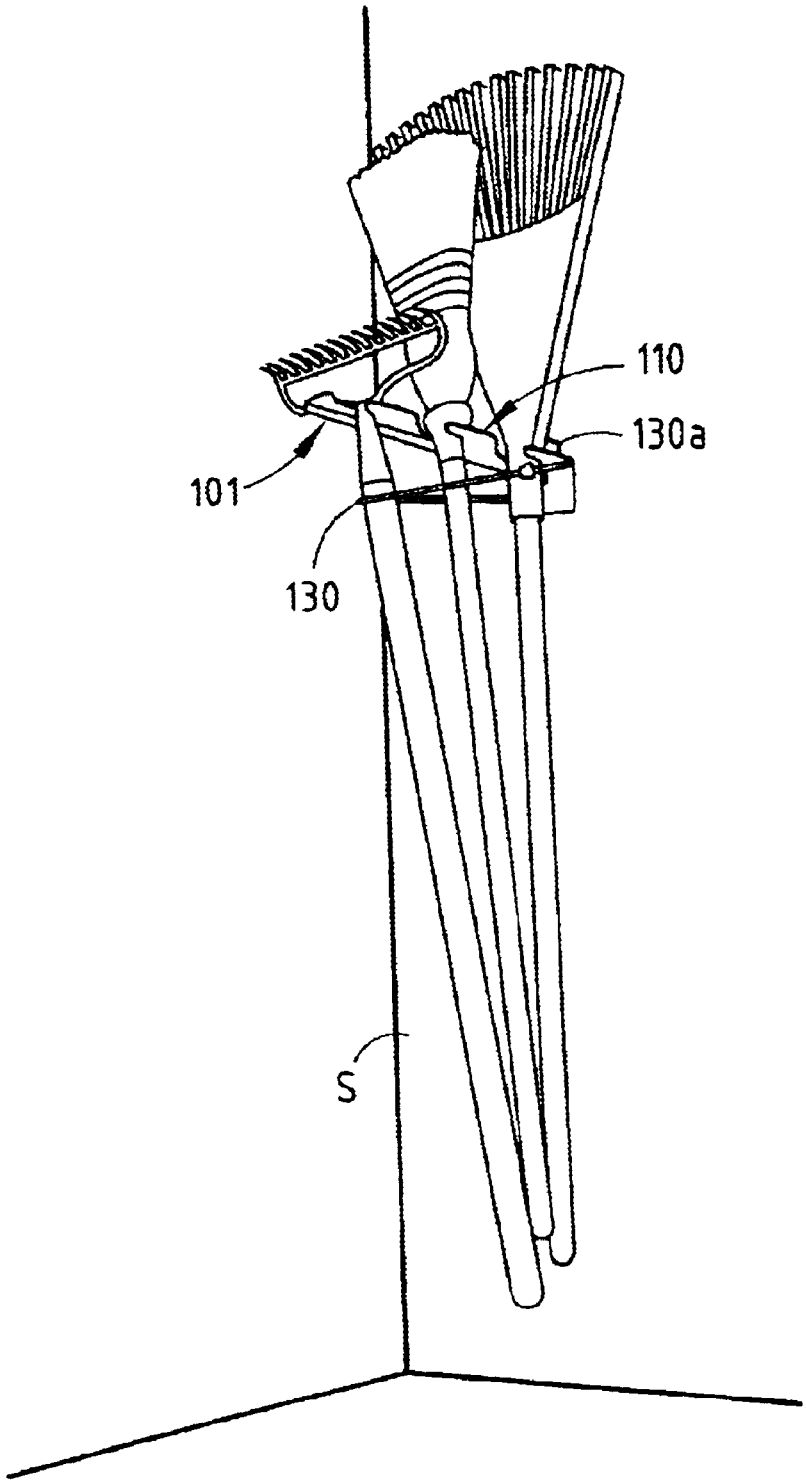
FIG. 10 is another side elevational perspective view of the rack of FIG. 7 supported on a vertical surface, fully loaded with elongated items which are held inwardly toward the vertical surface by a bungee cord.
Figure 11:
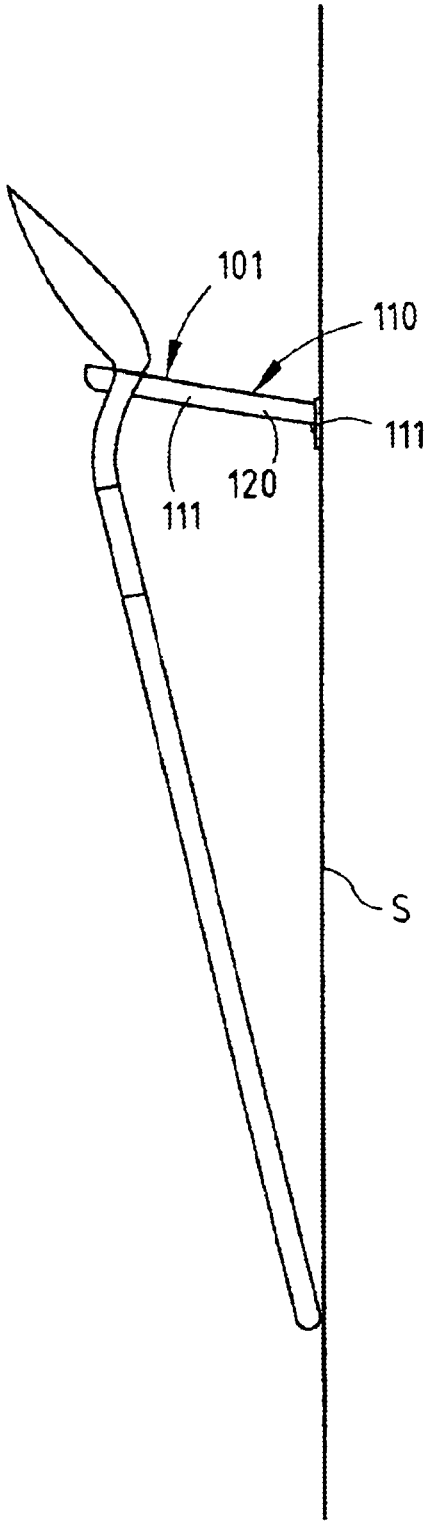
FIG. 11 is a side elevational view of the rack of FIG. 7 supported on a vertical surface and illustrating how a curved neck shovel naturally angles toward the vertical surface.

FIGS. 7–11 disclose a second embodiment of my invention which includes a rack 101 having a single leg 110 extending from the vertical surface "s" (FIGS. 9, 10, and 11). Leg 110 is essentially like leg 10 of FIG. 1 except for the flange 120 extending downwardly from one side of the flat bar-like section 121 of leg 110. Flange 120 is formed integrally with the flat bar-like section 121. Also extending downwardly from leg 110 and formed integrally with the end of bar-like section 121 is the flange 111 which provides the means for supporting leg 110.

Flange 120 extends down the entire length of the bar-like section 121 and engages flange 111. The bar-like section 121 also includes the uniquely shaped slots 114 best disclosed in FIG. 8 and which are very similar to slots 14 (FIG. 1) it being understood they could be identical. Slots 114 each comprise an entrance opening portion 115 on the side of section 121 opposite flange 120. Inlet opening portion 115 leads into a retainer opening portion 116. Slots 114 each take the form of edges 118*a*, 118*b*, and arcuate edge 118*c*. Between edges 118*a*, 118*b*, and edge 118*c* are provided the indentations 118*d* which receive the bowed support members of a rake such as rake 5 of FIG. 2. Indentation 118*d* also helps retain other items as well. The size of slots 114 are sufficiently large to receive an elongated member of rakes, hoes, shovels, brooms, and other items.

The bar-like section 110 is slightly inclined at an angle of about 10 to 15 degrees so that when the handle of an elongated element of the tool is inserted in the entrance opening portion 115 of a slot 114, it will slide downwardly along edge 118*c* by reason of gravity and the inclination of bar-like section 121 toward the vertical surface on which the rack is mounted so as to abut against the edge 118*b* of the slot 114.

Flange 120 serves the function of reinforcing the strength of bar-like section 121, that is, to prevent section 124 from bending when tools are hung on it. Flange 111 includes the key hole opening 112 having a circular opening 112*a* leading into a smaller dimensional opening 112*b*. Opening 112*a* is provided to receive a screw head, and opening 112*b* is provided to receive the shank of a screw whereby the rack 101 can be mounted to a vertical surface by inserting opening 112*a* over the head of a screw so that subsequent pulling down on the rack 101 causes the shank of the screw to enter into opening 112*b*, after which, the screw can be tightened to secure rack 101 to the vertical surface. Also, the shape and position of key hole 112 is designed to provide for retail display.

Rack 101 also includes openings for hooks on which to hang items such as disclosed in FIG. 9 by hooks 123.

FIGS. 9, 10, and 11 illustrate how tools can be supported on rack 101. FIGS. 9 and 11 illustrate how curved necked shovels naturally cause their handles to angle toward the vertical support surface "s" so as to hold the handles of the tools inwardly toward the wall surface "s." FIG. 10 discloses how a bungee cord 130 can be secured to the rack 101 in the openings 122 which are also provided for hooks that can be used for hanging smaller items such as small hand shovels and other items.

The operation of rack 101 should be obvious from the description of the operation of the first embodiment of FIGS. 1–6. Obviously, the absence of the lower leg of FIGS. 1–6 eliminates the need to align the handles in two slots. On the other hand, if the tools being stored do not tend to incline toward the vertical wall surface, and that is desired, then a bungee chord 130 can be utilized by hooking the bungee hooks 130*a* on the rack 101, preferably in the openings 122 (FIG. 8) nearest the flange 111 (FIG. 7) as disclosed in FIG. 10.

Although I have described preferred embodiments of my invention, it should be understood that those skilled in the art may make modifications to my invention without departing from the conceptual spirit of it. Therefore, it is intended that all modifications made within the spirit of this invention are to be included within this application and equivalence thereof should be covered by this patent except as specifically provided by the appended claims.

The invention claimed is:

1. A storage rack for supporting in spaced relationship from a vertical support surface a plurality of items each having at least an elongated handle;

a single elongated bar having a length, thickness and width, said width being of greater dimension than said thickness, said bar having a top surface and bottom surface defining the thickness of said bar; a first end at one end of the length of said bar; a second end at the other end of the length of said bar; an attachment at said first end adapted for attachment to said vertical support surface so as to support said bar in cantilevered fashion with the length of the bar extending away from the vertical support surface, with the second end spaced from the vertical support surface and with said top surface facing upwardly and said bottom surface facing downwardly; said bar having a first side having a first edge and a second side having a second edge, said edges extending along said top surface and said bottom surface; the angle between said attachment located at said first end and said length of said bar being such as to support said bar on said vertical support surface at an inclined angle away from said vertical support surface with one of said first and second ends being lower than the other of said first and second ends and with said top surface facing upwardly and said bottom surface facing downwardly;

a series of slots in said bar extending from the first edge of said bar toward but short of said second edge; said slots extending downwardly through said bar including through said top surface and bottom surface; said series of slots spaced along the length of said bar between said first and second ends at various distances from said attachment; and said slots shaped to provide an inlet opening in said first edge leading into a retainer opening extending from said inlet opening toward said one of said first and second ends being lower than the other of said first and second ends, said retainer opening having laterally spaced side edges, which are spaced inwardly from said first and second edges of said elongated bar, whereby an elongated part inserted in said inlet opening can be slid toward one of said first and second ends being lower than the other of said first and second ends into said retainer opening and held therein by virtue of gravity and the inclination of said bar;

wherein said attachment is formed integrally from material of the elongated bar and the bar includes a bent portion that positions the attachment at an angle to the top surface.

2. The storage rack of claim 1 in which indentations are provided in the retainer opening to aid in the retention of stored items.

3. A combination including the storage rack defined in claim 1, and further including at least one of a long-handled broom, a shovel, and a rake stored on the storage rack.

4. A storage rack for supporting in spaced relationship away from a vertical support surface a plurality of items, said storage rack comprising:

a single generally flat member having a first end, a second end, a first side having a first edge, a second side having a second edge, and top and bottom surfaces defining the thickness of said generally flat member; said generally flat member having an attachment at said first end for attachment to said vertical support surface so as to support said generally flat member in cantilevered fashion extending away from said attachment and said vertical support surface with said top surface facing upwardly and said bottom surface facing downwardly;

a series of slots in said generally flat member extending from said first edge of said generally flat member toward but short of said second edge and extending through said top surface and bottom surface, said series of slots being spaced along said first edge of said generally flat member between said first and second ends; and said slots being shaped to provide an inlet opening in said first edge leading into a retainer opening extending from said inlet opening toward one of said first and second ends, said retainer opening having laterally spaced side edges, which are spaced inwardly from said first and second edges of said generally flat member, whereby an elongated handle can be inserted through said inlet opening and slid into said retainer opening;

wherein said attachment is formed integrally from material of the fiat member and the flat member includes a bent portion that positions the attachment at an angle to the top surface.

5. The storage rack of claim 4 in which indentations are provided in the retainer opening for receiving bowed support members of a bow rake.

6. The storage rack of claim 4 in which said generally flat member includes a strengthening flange extending downwardly from said second side along a substantial length of said bar.

7. The storage rack of claim 6 in which the end of said strengthening flange nearest said attachment engages said attachment.

8. A combination including the storage rack defined in claim 4, and further including at least one of a long-handled broom, a shovel, and a rake stored on the storage rack.

9. A storage rack for supporting in spaced relationship away from a vertical support surface a plurality of items, said storage rack comprising:

a single generally flat member having a first end, a second end, a first side having a first edge, a second side having a second edge, and top and bottom surfaces defining the thickness of said generally flat member; said generally flat member having an attachment at said first end for attachment to said vertical support surface so as to support said generally flat member in cantilevered fashion extending away from said attachment and said vertical support surface with said top surface facing upwardly and said bottom surface facing downwardly;

a series of slots in said generally flat member extending from said first edge of said generally flat member toward but short of said second edge and extending through said top surface and bottom surface, said series of slots being spaced along said first edge of said generally flat member between said first and second ends;

said slots being shaped to provide an inlet opening in said first edge leading into a retainer opening extending from said inlet opening toward one of said first and second ends, said retainer opening having laterally spaced side edges, which are spaced inwardly from said first and second edges of said generally flat member, whereby an elongated handle can be inserted through said inlet opening and slid into said retainer opening; and the angle between said attachment located at said first end and said generally flat member being configured to support said generally flat member at an inclined angle away from a vertical support surface; said retainer opening extending toward the lower of said first and second ends when said generally flat member is attached to said vertical support surface;

wherein said attachment is formed integrally from material of the flat member and the flat member includes a bent portion that positions the attachment at a selected angle to the top surface.

10. A combination including the storage rack defined in claim 9, and further including at least one of a long-handled broom, a shovel, and a rake stored on the storage rack.

11. A storage rack in combination with a vertical surface and a curved neck shovel having an elongated handle whereby the shovel is supported by said storage rack in a manner that the handle of the shovel angles toward the vertical surface and said shovel is supported in spaced relationship from the vertical surface;

said storage rack comprising a single elongated bar having a length and width, said length being greater than its width; said bar having a first end, a second end, a first side having a first edge, and a second side having a second edge; said bar having a top surface and a bottom surface, said top and bottom surfaces extending between said first and second edges; said bar having an attachment located at said first end, attached to said vertical surface so as to support said bar in cantilevered fashion with the length of the bar extending away from the vertical surface and said second end spaced from the vertical surface, with said top surface facing upwardly and said bottom surface facing downwardly;

a series of slots in said bar extending from the first edge of said bar toward but short of the second edge and through said top surface and bottom surface; said series of slots spaced along the length of said bar at various distances from the attachment and the vertical surface;

said slots extending entirely through portions of said top surface, and bottom surface and receiving the handle of said curved neck shovel extending downwardly through one of said slots when said attachment supports said bar on the vertical surface; and said slots shaped to provide an inlet opening in said first edge leading into a retainer opening extending from said inlet opening longitudinally of said bar, said retainer opening having laterally spaced side edges, which are spaced inwardly from said first and second edges of said elongated bar, whereby the elongated handle of said curved neck shovel can be inserted through said inlet opening and slid into said retainer opening.

12. The storage rack of claim 11, in which said bar includes holes therein for receiving hooks for supporting additional items.

13. The storage rack of claim 11, in which the angle between said attachment located at said first end and said length of said bar being such as to support said bar on said vertical surface at an inclined angle away from said vertical surface with one of said first and second ends being lower than the other of said first and second ends.

14. A storage rack for supporting in spaced relationship from a vertical support surface a plurality of items each having at least an elongated handle, comprising:

a single flat bar having a first end and a second end, a top surface and a bottom surface defining the thickness of said bar, a first side having a first edge, and a second side having a second edge, said edges defining the width of said bar, said width being greater in dimension than said thickness;

said first end having an attachment adapted to attach said bar to said vertical support surface for supporting said bar on said vertical support surface in cantilevered fashion with both of said first and second edges extending away from said vertical support surface and said top surface facing upwardly and said bottom surface facing downwardly;

a series of slots in said bar extending from at least the first edge of said bar toward but short of said second edge through said bar; said series of slots spaced along the first edge of said bar between said first and second ends at various distances from the attachment and the vertical support surface;

said slots extending through and from said top surface of said bar to and through said bottom surface of said bar for receiving the handles of items extending downwardly through said slots when said attachment supports said bar on said vertical support surface; and said slots shaped to provide an inlet opening in said first edge leading into a retainer opening extending from said inlet opening toward at least one of said ends of said bar, said retainer opening having laterally spaced side edges, which are spaced inwardly from said first and second edges of said elongated bar, whereby an elongated part can be inserted in said inlet opening and slid into said retainer opening;

wherein said attachment is formed integrally from material of the flat bar and the flat bar includes a bent portion that positions the attachment at an angle to the top surface.

15. A The storage rack of claim 14 in which indentations are provided in the retainer opening for receiving bowed support members of a bow rake.

16. The storage rack of claim 14 in which indentations are provided in the retainer opening to aid in the retention of stored items.

17. The storage rack of claim 14 in which said bar has a dimension from the first end to the second end greater than the dimension from the first side to the second side and said bar includes a flange extending downwardly from said second side to provide an L-shaped bar.

18. The storage rack of claim 14 in which said attachment is an attachment flange extending downwardly from the first end of said bar.

19. The storage rack of claim 14 in which said bar has a dimension from the first end to the second end greater than the dimension from the first side to the second side and said bar includes a strengthening flange extending downwardly from said second side along a substantial length of said bar.

20. The storage rack of claim 19 in which the end of said strengthening flange nearest said attachment flange engages said attachment flange.

21. A storage rack in combination with a vertical support surface and a plurality of items having elongated handles, said storage rack supporting said items in spaced relationship away from said vertical support surface;

said storage rack constructed from a single elongated bar having a length, thickness and width, said width being of greater dimension than said thickness; said bar having an attachment for attachment to said vertical support surface so as to support said bar in cantilevered fashion with a cantilevered end of said bar extending away from the attachment and said vertical support surface; said bar having a first edge, and a second edge; said bar when supported on said vertical support surface by said attachment having a top surface and a bottom surface; said top and bottom surfaces extending between said first and second edges, said attachment shaped to support said bar at an angle away from said vertical support surface with said top surface facing upwardly and said bottom surface facing downwardly;

a series of slots in said bar extending from the first edge of said bar toward but short of the second edge through spaced portions of said bar; said top surface and bottom surface defining the thickness of said bar; said series of slots spaced along said bar between said attachment and said cantilevered end of said bar;

said slots extending downwardly through and from said top surface of said bar to and through said bottom surface of said bar for receiving said handles of said items extending downwardly through said slots with said attachment supporting said bar on said vertical support surface; and said slots shaped to provide an inlet opening in said first edge leading into a retainer opening extending from said inlet opening longitudinally of said bar, said retainer opening having laterally spaced side edges, which are spaced inwardly from said first and second edges of said elongated bar, said retainer opening being shaped to hold said handles in said slots, said inlet opening permitting said handles to be removed from said slots and to be reinserted through said inlet opening and slid into said retainer opening;

wherein said attachment is formed integrally from material of the bar and the bar includes a bent portion that positions the attachment at an angle to the top surface.

22. A storage rack for supporting in spaced relationship from a vertical support surface a plurality of items each having at least an elongated handle;

a single elongated bar having a length, thickness and width, said width being of greater dimension than said thickness, said bar having a top surface and bottom surface defining the thickness of said bar; a first end at one end of the length of said bar; a second end at the other end of the length of said bar; an attachment at said first end adapted for attachment to said vertical support surface so as to support said bar in cantilevered fashion with the length of the bar extending away from the vertical support surface, with the second end spaced from the vertical support surface and with said top surface facing upwardly and said bottom surface facing downwardly; said bar having a first side having a first edge and a second side having a second edge, said edges extending along said top surface and said bottom surface; the angle between said attachment located at said first end and said length of said bar being such as to support said bar on said vertical support surface at an inclined angle away from said vertical support surface with one of said first and second ends being lower than the other of said first and second ends and with said top surface facing upwardly and said bottom surface facing downwardly;

a series of slots in said bar extending from the first edge of said bar toward but short of said second edge; said slots extending downwardly through said bar including through said top surface and bottom surface; said series of slots spaced along the length of said bar between said first and second ends at various distances from said attachment; and said slots shaped to provide an inlet opening in said first edge leading into a retainer opening extending from said opening toward said one of said first and second ends being lower than the other of said first and second ends, said retainer opening having laterally spaced side edges, which are spaced inwardly form said first and second edges of said elongated bar, whereby an elongated part inserted in said inlet opening can be slid toward one of said first and second ends being lower than the other of said first and second ends into said retainer opening and held therein by virtue of gravity and the inclination of said bar;

said bar including holes therein for receiving hooks for supporting additional items, each hole having a closed peripheral wall.

23. A storage rack for supporting in spaced relationship away from a vertical support surface a plurality of items, said storage rack comprising:

a single generally flat member having a first end, a second end, a first side having a first edge, a second side having a second edge, and top and bottom surfaces defining the thickness of said generally flat member; said generally flat member having an attachment at said first end for attachment to said vertical support surface so as to support said generally flat member in cantilevered fashion extending away from said attachment and said vertical support surface with said top surface facing upwardly and said bottom surface facing downwardly;

a series of slots in said generally flat member extending from said first edge of said generally flat member toward but short of said second edge and extending through said top surface and said bottom surface, said series of slots being spaced along said first edge of said generally flat member between said first and second ends; and said slots being shaped to provide an inlet opening in said first edge leading into a retainer opening extending from said inlet opening toward one of said first and second ends, said retainer opening having laterally spaced side edges, which are spaced inwardly from said first and second edges of said generally flat member, whereby an elongated handle can be inserted through said inlet opening and slid into said retainer opening; and said bar includes holes therein for receiving hooks for supporting additional items;

wherein said attachment is formed integrally from material of the flat member and the flat member includes a bent portion that positions the attachment at an angle to the top surface.

24. A storage rack for supporting in spaced relationship from a vertical support surface a plurality of items each having at least an elongated handle;

a single flat bar having a first end and a second end, a top surface and a bottom surface defining the thickness of said bar, a first side having a first edge, and a second side having a second edge, said edges defining the width of said bar, said width being greater in dimension than said thickness;

said first end having an attachment adapted to attach said bar to said vertical support surface for supporting said bar on said vertical support surface in cantilevered fashion with both of said first and second edges extending away from said vertical support surface and said top surface facing upwardly and said bottom surface facing downwardly;

a series of slots in said bar extending from at least the first edge of said bar toward but short of said second edge through said bar; said series of slots spaced along the first edge of said bar between said first and second ends at various distances from the attachment and the vertical wall;

said slots extending through and from said top surface of said bar to and through said bottom surface of said bar for receiving the handles of items extending downwardly through said slots when said attachment supports said bar on said vertical support surface; and said slots shaped to provide an inlet opening in said first edge leading into a retainer opening extending from said inlet opening toward at least one of said ends of said bar, said retainer opening having laterally spaced side edges, which are spaced inwardly from said first and second edges of said elongated bar, whereby an elongated part can be inserted in said inlet opening and slid into said retainer opening; and said bar includes holes therein for receiving hooks for supporting additional items;

wherein said attachment is formed integrally from material of the bar and the bar includes a bent portion that positions the attachment at an angle to the top surface.

25. A storage rack in combination with a vertical support surface and a plurality of items having elongated handles said storage rack supporting said items in spaced relationship away from said vertical support surface;

said storage rack constructed from a single elongated bar having a length, thickness and width, said width being of greater dimension than said thickness; said bar having an attachment for attachment to said vertical support surface so as to support said bar in cantilevered fashion with a cantilevered end of said bar extending away from the attachment and said vertical support surface; said bar having a first edge, and a second edge; said bar when supported on said vertical support surface by said attachment having a top surface and a bottom surface; said top and bottom surfaces extending between said first and second edges, said attachment shaped to support said bar at an angle away from said vertical support surface with said top surface facing upwardly and said bottom surface facing downwardly;

a series of slots in said bar extending from the first edge of said bar toward but short of the second edge through spaced portions of said bar; said top surface and bottom surface defining the thickness of said bar; said series of slots spaced along said bar between said attachment and said cantilevered end of said bar;

said slots extending downwardly through and from said top surface of said bar to and through said bottom surface of said bar for receiving said handles of said items extending downwardly through said slots with said attachment supporting said bar on said vertical support surface; and said slots shaped to provide an inlet opening in said first edge leading into a retainer opening extending from said inlet opening longitudinally of said bar, said retainer opening having laterally spaced side edges, which are spaced inwardly from said first and second edges of said elongated bar, said retainer opening being shaped to hold said handles in said slots, said inlet opening permitting said handles to be removed from said slots and to be reinserted through said inlet opening and slid into said retainer opening;

wherein said bar includes holes therein for receiving hooks for supporting additional items, each hole having a closed peripheral wall.

26. A storage rack for supporting in spaced relationship from a vertical support surface a plurality of items, said rack consisting essentially of:

a single elongated bar having a length, thickness and width, said width being of greater dimension than said thickness, said bar having a top surface and bottom surface defining the thickness of said bar; a first end at one end of the length of said bar; a second end at the other end of the length of said bar; said first end terminating at and joining a downwardly extending attachment adapted for attachment to the vertical support surface so as to support said bar in cantilevered fashion with the length of the bar extending away from the vertical support surface, with the second end spaced from the vertical support surface and with said top surface facing upwardly and said bottom surface facing downwardly; said bar having a first side having a first edge and a second side having a second edge, said edges extending along said top surface and said bottom surface;

a series of slots in said bar extending from the first edge of said bar toward but short of said second edge; said slots extending downwardly through said bar including through said top surface and bottom surface; said series of slots spaced along the length of said bar between said first and second ends at various distances from said attachment; and said slots shaped to provide an inlet opening in said first edge leading into a retainer opening extending from said inlet opening toward one of said first and second ends;

wherein said attachment is formed integrally from material of the elongated bar and the bar includes a bent portion that positions the attachment at an angle to the top surface.

27. The storage rack of claim 26, in which the angle between said attachment located at said first end and said length of said bar is such as to support said bar on said vertical support surface at an inclined angle away from said vertical support surface with one of said first and second ends being lower than the other of said first and second ends and with said top surface facing upwardly and said bottom surface facing downwardly;

one of said ends being lower than the other of said first and second ends, said retainer opening having laterally spaced side edges, which are spaced inwardly from said first and second edges of said elongated bar, whereby an elongated part inserted in said inlet opening can be slid toward one of said first and second ends being lower than the other of said first and second ends into said retainer opening and held therein by virtue of gravity and the inclination of said bar.

28. A combination including the storage rack defined in claim 26, and further including at least one of a long-handled broom, a shovel, and a rake stored on the storage rack.

29. A storage rack for supporting in spaced relationship from a vertical support surface a plurality of items, said rack consisting essentially of:

a single elongated bar having a length, thickness and width, said width being of greater dimension than said thickness, said bar having a top surface and bottom surface defining the thickness of said bar; a first end at one end of the length of said bar; a second end at the other end of the length of said bar; said first end terminating at and joining a downwardly extending attachment adapted for attachment to the vertical support surface so as to support said bar in cantilevered fashion with the length of the bar extending away from the vertical support surface, with the second end spaced from the vertical support surface and with said top surface facing upwardly and said bottom surface facing downwardly; said bar having a first side having a first edge and a second side having a second edge, said edges extending along said top surface and said bottom surface;

a series of slots in said bar extending from the first edge of said bar toward but short of said second edge; said slots extending downwardly through said bar including through said top surface and bottom surface; said series of slots spaced along the length of said bar between said first and second ends at various distances from said attachment; and said slots shaped to provide an inlet opening in said first edge leading into a retainer opening extending from said inlet opening toward one of said first and second ends;

said bar including holes therein for receiving hooks for supporting additional items, each hole having a closed peripheral wall.

30. A combination including the storage rack defined in claim 29, and further including at least one of a long-handled broom, a shovel, and a rake stored on the storage rack.

* * * * *

UNITED STATES PATENT AND TRADEMARK OFFICE

CERTIFICATE OF CORRECTION

PATENT NO. : 6,719,153 B2
DATED : April 13, 2004
INVENTOR(S) : William R. Heneveld It is certified that error appears in the above-identified patent and that said Letters Patent is hereby corrected as shown below:

Column 4,
Line 61, “section 124” should be -- section 121 --;

Column 10,
Line 33, before “opening” insert -- inlet --;
Line 36, “form” should be -- from --.

Signed and Sealed this

Twentieth Day of July, 2004

JON W. DUDAS
*Acting Director of the United States Patent and Trademark Office*